US009849706B2

(12) United States Patent
Chretien

(10) Patent No.: US 9,849,706 B2
(45) Date of Patent: Dec. 26, 2017

(54) HOT STAMPING PRINTING DEVICE

(75) Inventor: Julien Chretien, Métabief (FR)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 14/009,885

(22) PCT Filed: Apr. 5, 2012

(86) PCT No.: PCT/EP2012/001521
§ 371 (c)(1),
(2), (4) Date: Oct. 4, 2013

(87) PCT Pub. No.: WO2012/136373
PCT Pub. Date: Oct. 11, 2012

(65) Prior Publication Data

US 2014/0020575 A1 Jan. 23, 2014

(30) Foreign Application Priority Data

Apr. 5, 2011 (EP) ..... 11002812

(51) Int. Cl.

| | |
|---|---|
| ***B41K 3/20*** | (2006.01) |
| ***B41K 3/30*** | (2006.01) |
| ***B30B 15/06*** | (2006.01) |
| ***B41F 19/00*** | (2006.01) |
| ***B41F 16/00*** | (2006.01) |

(52) U.S. Cl.
CPC ..... *B41K 3/30* (2013.01); *B30B 15/064* (2013.01); *B41F 16/0046* (2013.01); *B41F 16/0066* (2013.01); *B41F 19/008* (2013.01)

(58) Field of Classification Search
CPC ... B41K 3/00; B41K 3/02; B41K 3/24; B41K 3/04
USPC ..... 101/4, 21, 27, 31
See application file for complete search history.

(56) References Cited

U.S. PATENT DOCUMENTS

| | | | |
|---|---|---|---|
| 1,554,235 | A | 9/1925 | Seagers |
| 3,398,679 | A | 8/1968 | Grivet |
| 3,447,079 | A | 5/1969 | Durbin |

(Continued)

FOREIGN PATENT DOCUMENTS

| | | |
|---|---|---|
| CA | 455 420 | 3/1949 |
| CN | 101554794 A | 10/2009 |

(Continued)

OTHER PUBLICATIONS

International Search Report dated Oct. 2 2012 issued in corresponding International patent application No. PCT/EP2012/001521.

(Continued)

*Primary Examiner* — David Banh
(74) *Attorney, Agent, or Firm* — Ostrolenk Faber LLP

(57) ABSTRACT

A device 300 for printing a succession of sheets, includes a platen press 310 for depositing colored or metalized film on each sheet by stamping between a stationary platen 320 and a movable platen 330. A heating element 340 brings a stamping tool integral with the stationary platen 320 to a given temperature for a stamping operation. The heating element 340 is displaced between an operating position between the stationary platen 320 and each stamping tool associated with that platen 320, and a maintenance position in which the heating element is outside the platen press 310.

18 Claims, 6 Drawing Sheets

(56) References Cited

U.S. PATENT DOCUMENTS

| | | | | |
|---|---|---|---|---|
| 3,969,051 | A | 7/1976 | Hovila | |
| 4,559,800 | A | 12/1985 | Brown | |
| 4,628,810 | A | 12/1986 | Chan | |
| 5,134,931 | A * | 8/1992 | Thompson et al. | 101/27 |
| 5,179,879 | A | 1/1993 | Yerly | 83/34 |
| 5,318,660 | A * | 6/1994 | Olsen et al. | 156/542 |
| 5,651,296 | A * | 7/1997 | Halm et al. | 83/451 |
| 5,722,320 | A * | 3/1998 | Meyer | 101/32 |
| 5,797,763 | A * | 8/1998 | Saka et al. | 439/402 |
| 6,213,676 | B1 | 4/2001 | Rebeaud | 403/188 |
| 7,306,482 | B1 * | 12/2007 | Kidman | 439/538 |
| 2004/0150135 | A1 * | 8/2004 | Hennessey et al. | 264/293 |
| 2004/0206254 | A1 * | 10/2004 | Both et al. | 101/27 |
| 2007/0102843 | A1 | 5/2007 | Waatti | |
| 2008/0264284 | A1 * | 10/2008 | Hutchison et al. | 101/389.1 |
| 2010/0310696 | A1 | 12/2010 | Schlepp | |

FOREIGN PATENT DOCUMENTS

| | | | |
|---|---|---|---|
| CN | 201442377 | U | 4/2010 |
| CN | 201544519 | U | 8/2010 |
| DE | 699 671 | | 12/1940 |
| DE | 1 175 976 | | 8/1964 |
| DE | 11 94 874 | | 6/1965 |
| DE | 91 12 988 | U1 | 2/1992 |
| EP | 0 916 489 | | 5/1999 |
| FR | 1 519 378 | | 3/1968 |
| FR | 2 532 585 | A1 | 3/1984 |
| GB | 277 512 | | 9/1927 |
| GB | 890 940 | | 3/1962 |
| GB | 2 138 344 | | 10/1984 |
| JP | A 3-106686 | | 5/1991 |
| JP | A 11-245377 | | 9/1999 |
| TW | I256342 | | 6/2006 |
| TW | 200730324 | | 8/2007 |
| WO | WO 2007/026978 | A1 | 3/2007 |

OTHER PUBLICATIONS

Office Action dated Aug. 25, 2014 issued in corresponding Korean Patent Application No. 2013-7028855 (with English translation).

Office Action dated Aug. 18, 2014 issued in corresponding Japanese Patent Application No. 2014-503030 (with English translation).

Office Action dated Sep. 22, 2014 issued in corresponding Chinese Patent Application No. 201280017082.X (with English translation).

Examination Report dated Aug. 4, 2014 issued in corresponding Taiwan Patent Application No. 101112021 (English translation only).

* cited by examiner

Fig. 3
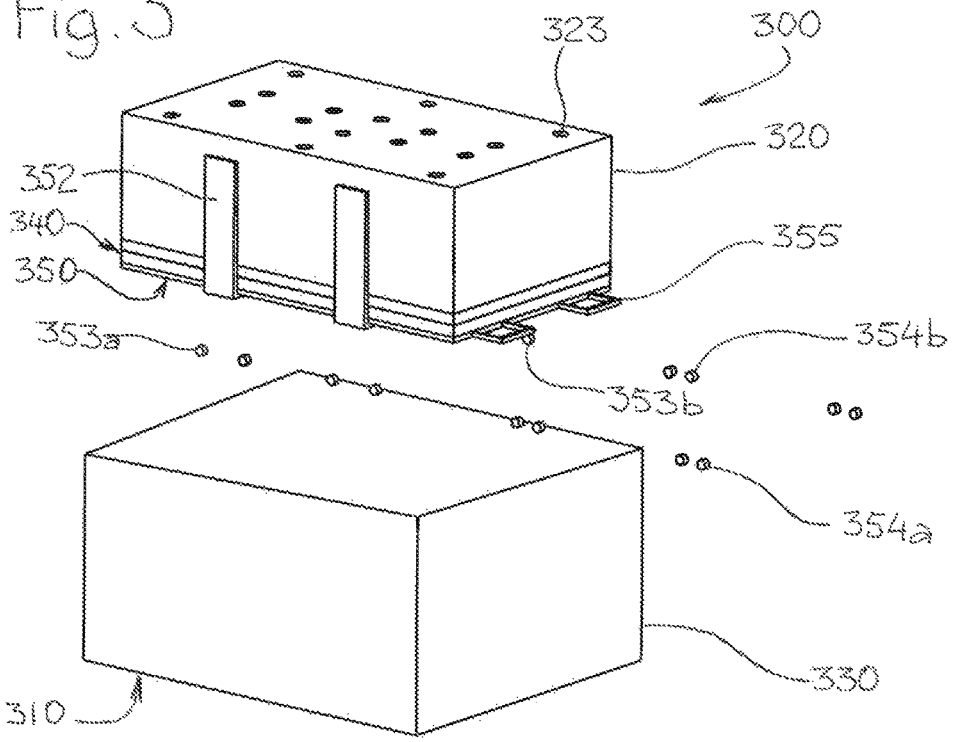
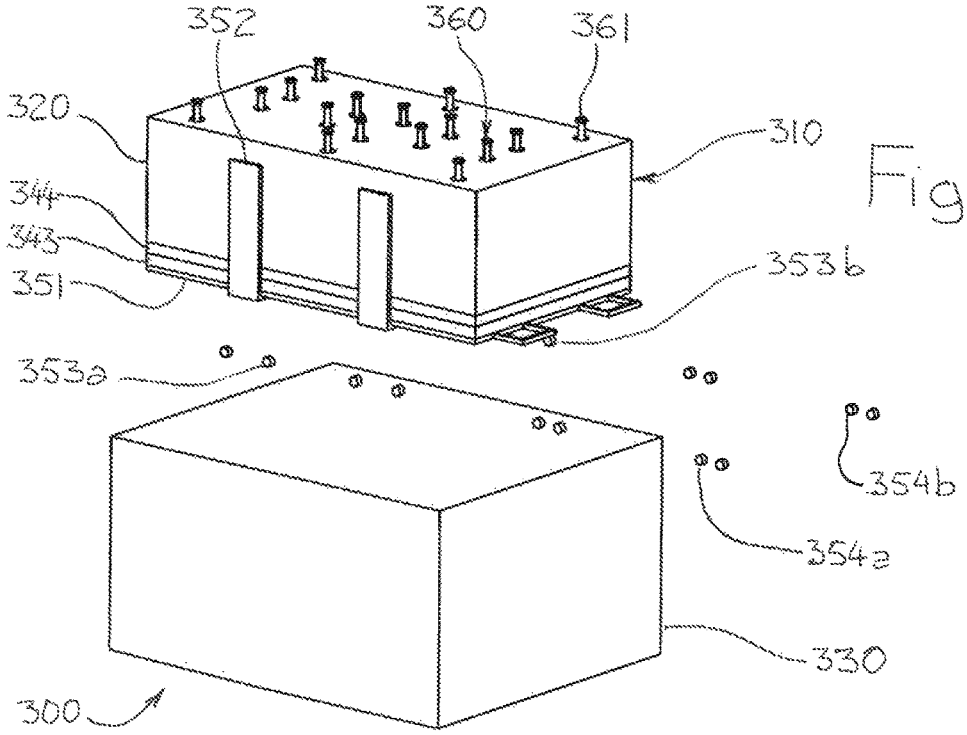
Fig. 4

HOT STAMPING PRINTING DEVICE

CROSS-REFERENCE TO RELATED APPLICATIONS

The present application is a 35 U.S.C. §§371 national phase conversion of PCT/EP2012/001521, filed Apr. 5, 2012, which claims priority of European Patent Application No. 11002812.3, filed Apr. 5, 2011, the contents of which are incorporated by reference herein. The PCT International Application was published in the French language.

The present invention relates to a device that allows a succession of elements in the form of sheets to be printed by hot stamping.

The invention is applied in a particularly advantageous but not exclusive manner in the field of manufacturing packaging intended for the luxury goods industry.

It is known to print text and/or patterns using stamping, in other words to deposit colored or metalized film coming from one or more stamping foils, commonly known as metalized strips, on a support in the form of a sheet by being pressed against it. In the industry, such a transfer operation is traditionally performed by means of a vertical platen press, in which each printing support and the relevant stamping foils are pressed together between two parallel platens, one of which is stationary while the other is mounted so that it can move by being displaced in a vertical back-and-forth motion.

In the case of hot stamping, the transfer of the film requires heat to be applied as well as pressure. For this reason, a heating element is usually inserted between the stationary platen and the stamping tools which are associated with the latter. Such a heating element generally takes the form of a heating plate, one face of which is covered with an insulating material intended to serve as an interface with the plate, while the other face is intended to extend behind the stamping tools.

In practice, the heating element is integrally connected to the stationary platen by means of multiple fastening screws which are fitted from the inside of the platen press. This means in practice that each of them passes through the heating element before being screwed into an internal screwthread formed in an appropriate manner in the platen.

However, this type of arrangement has the disadvantage of making it particularly difficult to access the heating element, which has the consequence of significantly complicating maintenance and repair work. Indeed, in order to fit and remove the fastening screws, someone needs to put their arms between the platens of the press, which proves to be extremely impractical. Moreover, in order to reach the fastening screws furthest away from the side on which the operator stands, some peripheral units placed directly upstream and downstream from the platen press often need to be removed. Lastly, the heating element needs to be supported by hand the whole time that units are being extracted or inserted into the platen press.

The technical problem which is to be overcome by the subject of the present invention is also to provide a device for printing a succession of elements in the form of sheets, comprising a platen press capable of depositing colored or metalized film coming from at least one stamping foil on each sheet by stamping between a stationary platen and a movable platen, and a heating element capable of bringing any stamping tool integral with the stationary platen to a given temperature so that the stamping operation takes place in a hot environment within the platen press, which printing device would allow the problems from the prior art to be avoided, in particular by affording much easier maintenance.

SUMMARY OF THE INVENTION

The solution to the technical problem posed consists, according to the present invention, in the heating element being mounted such that it can move in displacement between an operating position in which it is placed in between the stationary platen and each stamping tool associated with said platen, and a maintenance position in which it is arranged outside the platen press.

It should be emphasized that, at this stage of the description, the mobility of the heating element can in theory take the form of any kind of movement. Similarly, it may have any type of trajectory when displaced, in other words be solely straight or circular, be more generally curved, or result from any combination of these movements.

The important thing is that the operating position is that in which the heating element is fully operational, in other words can fulfill its heating function within the platen press. By contrast, in the maintenance position, it is essential that the heating element is situated outside the platen press, in a sufficiently accessible position so that it can be worked on directly or easily taken to an even more suitable place.

Whatever the case, the invention as defined has the advantage of requiring no intervention inside the platen press, either to extract or fit the heating element. Unlike similar versions from the prior art, the heating element according to the invention is not simply mounted removably, in other words fastened reversibly. It is also mounted so that it can move in displacement, which means that it is supported and guided mechanically during any transfer between the inside and the outside of the platen press. Any intervention on the heating element, for example to test its heating capacities independently of the rest of the machine, can therefore be made easily, quickly, and comfortably.

The present invention also relates to the features which will become apparent during the following description and should be considered in isolation or in all their possible technical combinations.

BRIEF DESCRIPTION OF THE DRAWINGS

This description, given by way of non-limiting example, is intended to better explain the subject of the invention and how it can be implemented. The description is moreover given with reference to the attached drawings, in which:

FIGS. 3 to 7 illustrate the kinematics for displacing the heating element relative to the platen press during transfer from the inside to the outside of said press.

FIG. 3 shows the heating element in the operating position inside the platen press.

FIG. 4 shows the heating element when it has been unlocked, at the beginning of the transfer phase.

FIG. 5 shows the heating element in an intermediate position of the transfer process.

FIG. 6 concerns the end of the transfer process, in other words the moment at which the heating element has reached its maintenance position.

FIG. 7 illustrates the withdrawal of the heating element from the maintenance position.

DESCRIPTION OF AN EMBODIMENT

Figure 1:
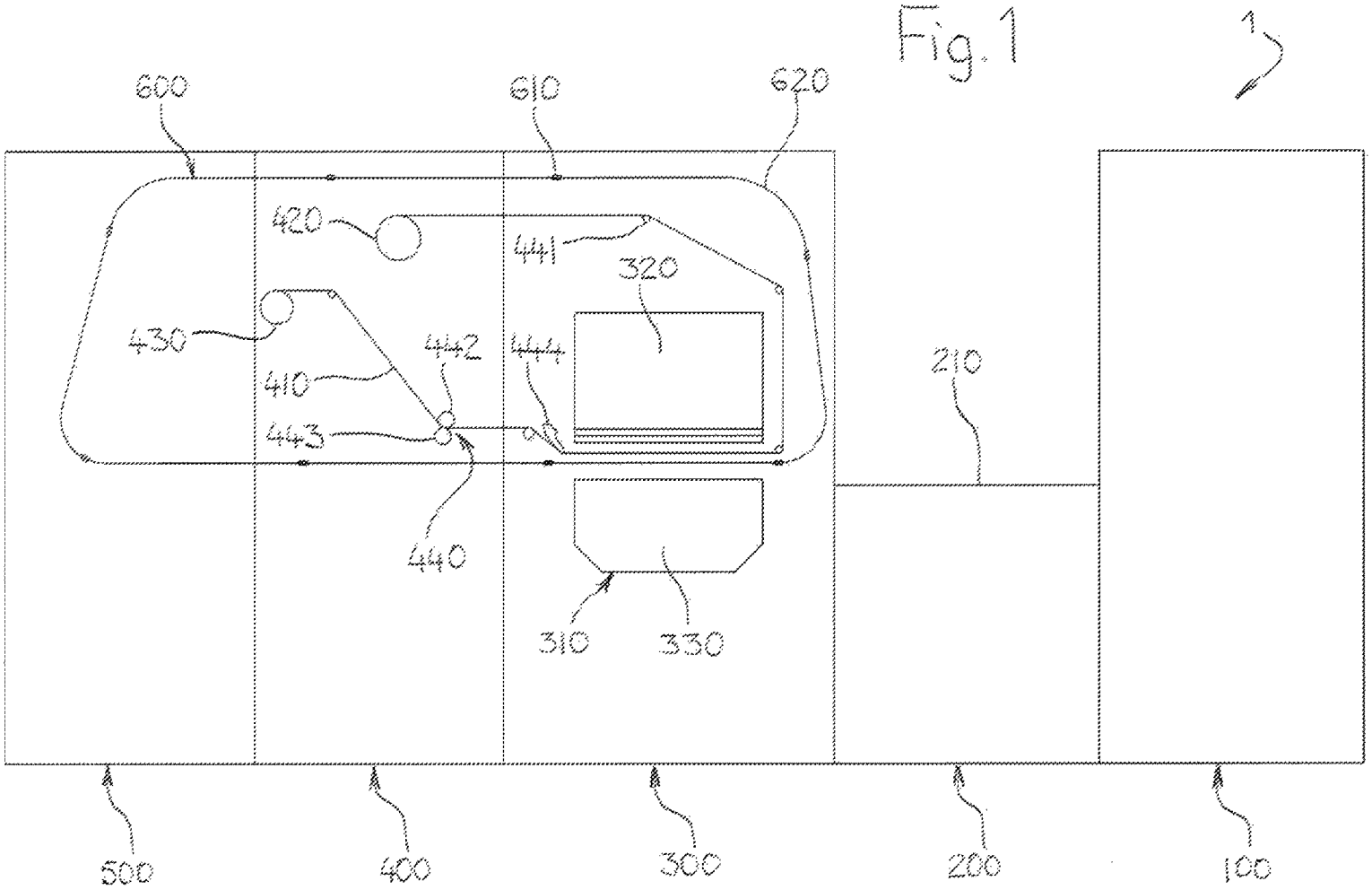
FIG. 1 shows a processing machine which is intended to print cardboard sheets using hot stamping and which is equipped with a printing device according to the invention for this purpose.

For greater clarity, the same elements have been designated by identical reference numerals, and only elements which are essential for understanding the invention have been shown, not to scale and schematically.

FIG. 1 illustrates a processing machine 1 which enables cardboard packaging intended for the luxury goods industry to be customized. Commonly called a gilding machine, this processing machine 1 conventionally consists of multiple work stations 100, 200, 300, 400, 500 which are juxtaposed but interdependent on each other so as to form a unit capable of processing a succession of sheet-form printing supports. A feeder 100, a feed table 200, a printing device 300, a foil supply and recovery station 400, and a delivery station 500 are thus found. Transport means 600 are moreover provided for individually displacing each sheet from the exit of the feed table 200 to the delivery station 500, including through the printing device 300.

Because the different parts 100, 200, 300, 400, 500, 600 of the processing machine 1 are very well known from the prior art, they will not be described in detail here in terms of their structure or operation.

It will simply be pointed out that, in this particular embodiment which has been chosen purely by way of example, the feeder 100 is provided with cardboard sheets from a succession of stacks stored on pallets. The sheets are taken in succession from the top of each stack by a suction gripping element which transports them to the directly adjacent feed table 200.

The sheets are placed on the feed table 200 by the suction gripping element one after the other so that they partially overlap. The whole stream is then driven in displacement along a board 210 toward the printing device 300 by means of a belt-driven transport mechanism. At the end of the stream, the leading sheet is systematically positioned precisely by means of front and side catches.

The work situation situated just after the feed table 200 is therefore the printing device 300. The purpose of this station is to deposit metalized film, which comes from a single stamping foil 410 in this exemplary embodiment, on each sheet by hot stamping. To do this, it uses a platen press 310 within which the stamping operation is effected between an upper platen 320 which is stationary, and a lower platen 330 which is mounted so that it can move in displacement in a vertical back-and-forth movement. Stamping tools (not shown) are of course associated with each of the platens 320, 330.

The foil supply and recovery station 400 is situated downstream from the printing device 300. As its name indicates, this station has a dual role since it is responsible for both supplying the machine with stamping foil 410 and removing this same foil once it has been used.

In this particular exemplary embodiment, the foil 410 is conventionally stored wound around a rotatably mounted supply reel 420. Analogously, after it has passed through the platen press 310, the foil 410 is wound around a rotatably mounted recovery reel 430. The foil 410 is driven in displacement between its storage point and its recovery point by a drive system 440 which is capable of circulating it over a given distance and over a specific unwinding route which passes in particular through the platen press 310. This foil drive system 440 mainly consists, on the one hand, of a series of deverting bars 441 which are placed along the unwinding route for guiding the displacement of the foil 410 and, on the other hand, of the combination of an advance shaft 442 and a press roller 443 which are positioned downstream from said unwinding route for driving said foil 410 in displacement. A guide 444 is moreover present just downstream from the platen press 310.

The process of processing the sheets finishes in the delivery station 500, the main purpose of which is to restack the sheets which have just been processed. To do this, transport means 600 are designed so that they automatically release each sheet when it is situated directly above the new stack. The sheet then falls square onto the top of the stack.

In a very conventional manner, the transport means 600 employ a series of clamping bars 610 which are mounted so that they can be moved in transverse translation via two sets of chains 620 arranged laterally on each side of the processing machine 1. Each set of chains 620 forms a loop which allows the clamping bars 610 to follow a trajectory passing successively through the printing device 300, the supply and removal station 400, and the delivery station 500.

Figure 2:
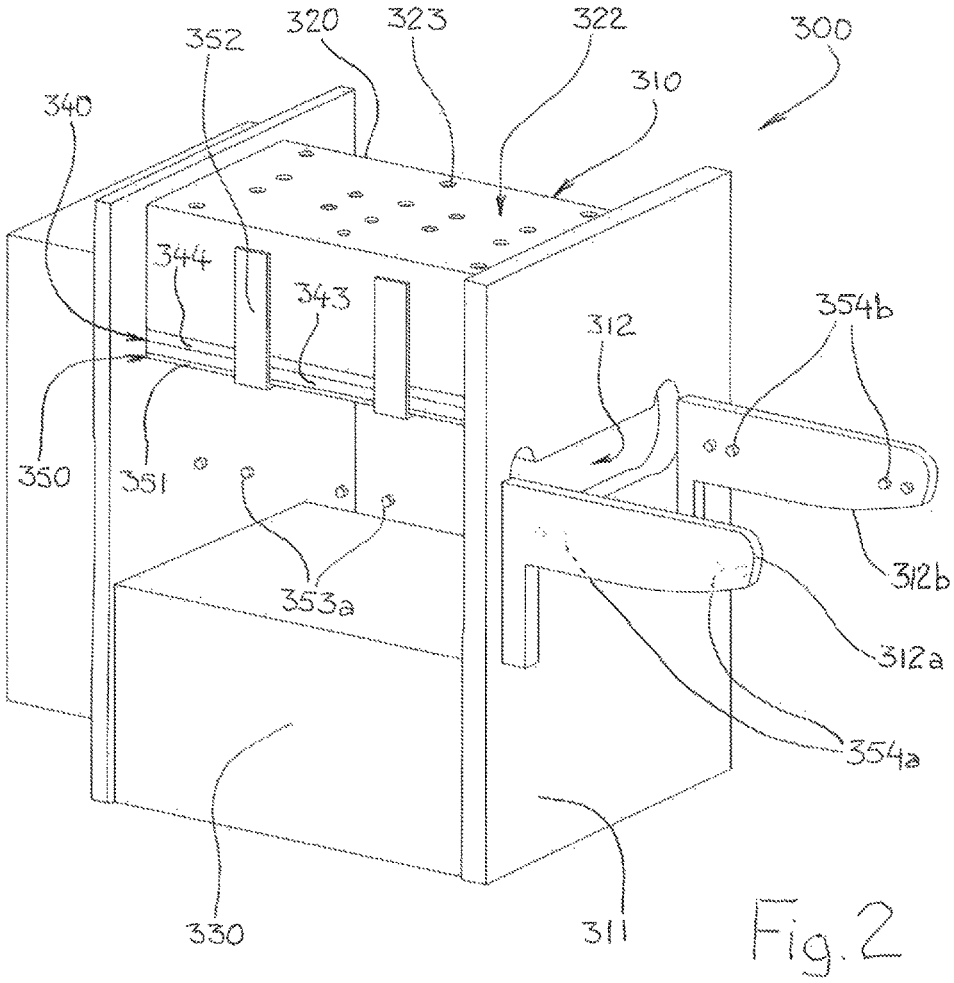
FIG. 2 is a perspective view which more specifically shows detail of the printing device which can be seen in FIG. 1.

As can be seen more precisely in FIG. 2, the printing device 300 is designed so as to be able to perform hot stamping. To do this, the platen press 310 is equipped with a heating element 340 which is capable of bringing each stamping tool (not shown) which is associated with the stationary platen 320 to a given temperature.

Figure 6:
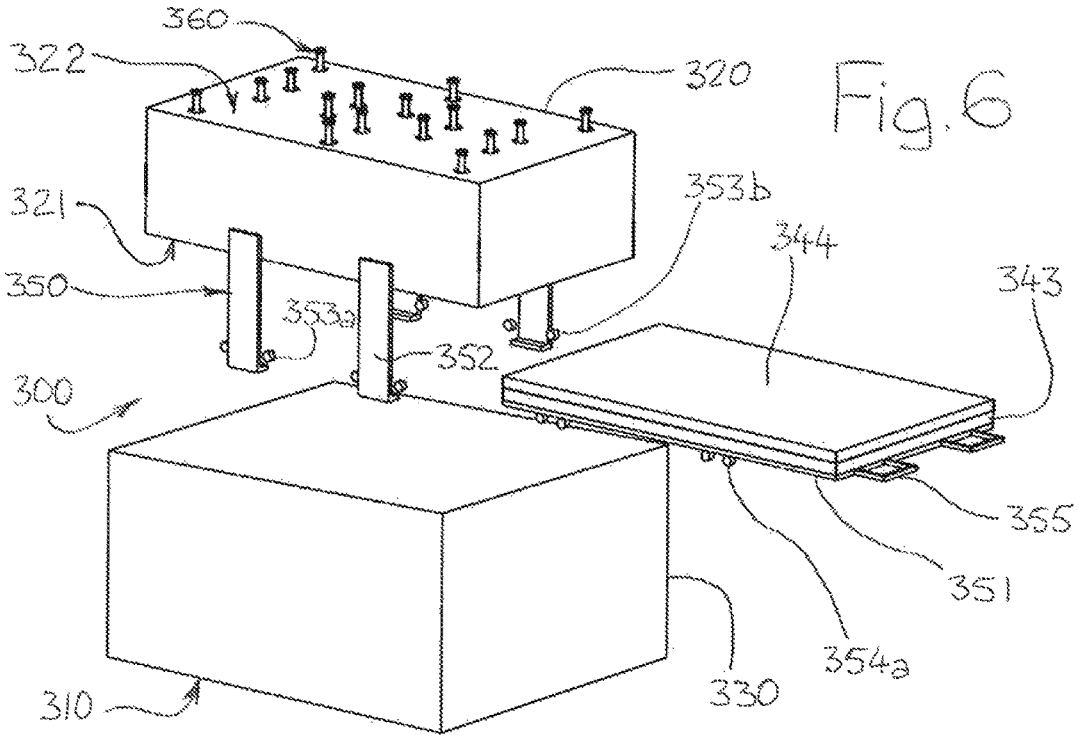

According to the subject of the present invention, this heating element 340 is mounted so that it can move in displacement between an operating position and a maintenance position. The unit is arranged such that, in the operating position, the heating element 340 is placed in between the stationary platen 320 and each stamping tool associated with said platen 320 (FIGS. 2 to 4), and, in the maintenance position, said heating element 340 is arranged outside the platen press 310 (FIG. 6).

According to one feature of the invention, the printing device 300 is equipped with means 350 which enable the heating element 340 to be transported between the operating position and the maintenance position. This feature entails in practice that the transport means 350 are capable of performing genuine support and guidance functions during the transfer of the heating element 340.

Figure 5:
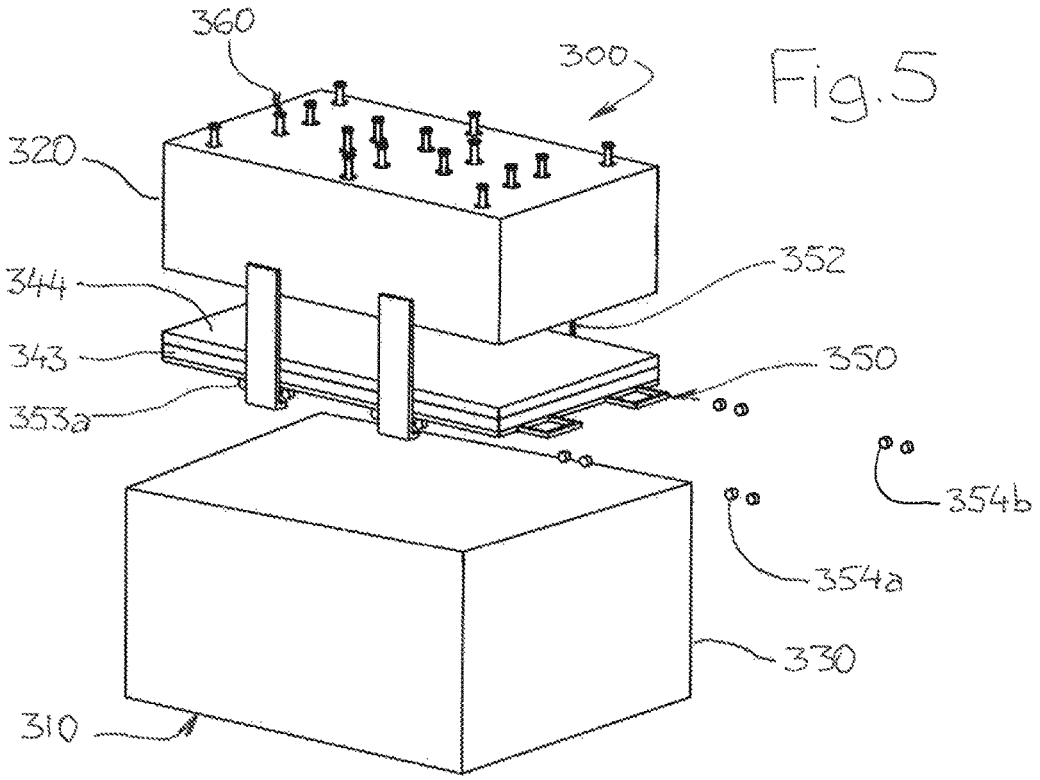

The printing device 300 is particularly advantageously designed in such a way that the heating element 340 is displaced in two stages. The transport means 350 are thus initially capable of moving the heating element 340 in translation in a direction substantially perpendicular to the inner face 321 of the stationary platen 320. This motion takes place between the operating position (FIGS. 3 and 4) and an intermediate position in which the heating element 340 is arranged between the two platens 320, 330 of the press 310 but at a distance from them (FIG. 5). However, the transport means 350 are moreover also capable of moving the heating element 340 in translation in a direction substantially parallel to the inner face 321 of the stationary platen 320. The motion takes place between the above-defined intermediate position (FIG. 5) and the maintenance position (FIG. 6).

Figure 7:
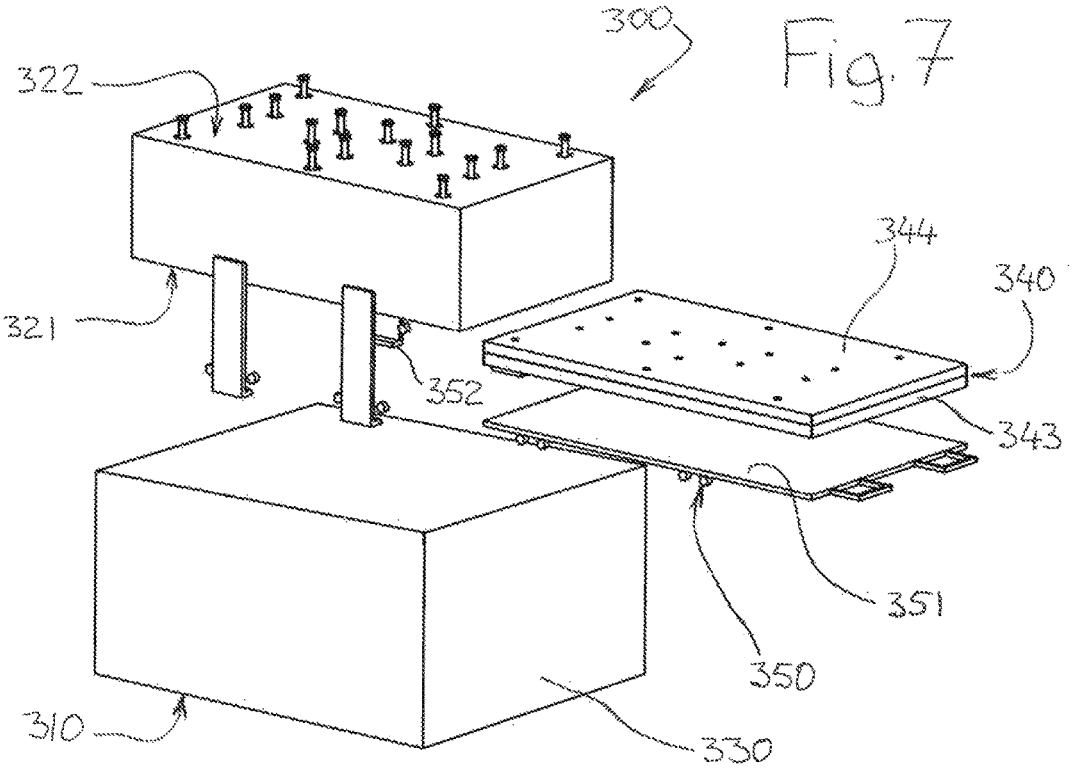

In the exemplary embodiment chosen to illustrate the invention, the printing device 300 is conventionally equipped with a frame 351 responsible for supporting each stamping tool associated with the stationary platen 320. Equally conventionally, this frame 351 is mounted so that it can move in displacement between a use position (FIGS. 3 and 4), in which it extends opposite and in contact with the heating element 340 in the operating position, and an extraction position in which it is arranged outside the platen press 310 (FIGS. 6 and 7).

In these conditions and according to a currently preferred embodiment of the invention, the frame 351 forming the transport means 350 can transport the heating element 340 between the operating position and the maintenance position when said frame 351 is displaced between the use position and the extraction position. The advantage of such an embodiment is that it avoids the need to design and install a specific system for transferring the heating element 340 by using a pre-existing transport system, in this case the movable frame 351 which is responsible for supporting the stamping tools associated with the stationary platen 320.

In practice, the movable unit formed by the heating element 340 placed on the frame 351 between the inside and outside of the platen press 310 is transferred transversely, passing through a lateral opening 312 formed through that part of the stand 311 situated on the side on which the operator stands.

The movable unit 340, 351 therefore begins to be displaced from the inside to the outside of the platen press 310 with the frame 351 being lowered vertically between the platens 320, 330 of the press 310.

This operation takes place in practice by means of four locking hooks 352 which are placed substantially at the four corners of the frame 351 and which are mounted so as to be capable of moving simultaneously in vertical translation so as to be able to transport said frame 351 horizontally. To do this, the motion of each hook 352 takes place between an upper position in which it applies the frame 351 against the heating element 340 which is itself in contact with the stationary platen 320 (FIGS. 3 and 4), and a lower position in which it stands at a distance from the frame 351 after having deposited it so that it bears on two series of transfer rollers 353*a*, 353*b* (FIGS. 5 to 7). The unit is arranged in such a way that when the frame 351 actually rests on these rollers 353*a*, 353*b*, the heating element 340 is in an intermediate position.

Between their upper position and their lower position, the synchronized translation of the four hooks 352 results from the combined action of individual elastic return means (not shown) and common unidirectional displacement means (not shown). In this exemplary embodiment, each hook 352 is indeed coupled with a stack of spring washers, forming elastic return means, which permanently force it into the upper position. It is, however, also coupled with a pneumatic system, forming unidirectional displacement means, which is capable of forcing it into the lower position when actuated, despite the permanent action of the elastic return means.

Once the intermediate position has been reached by the heating element 340, the movable unit 340, 351 continues to be displaced from the inside to the outside of the platen press 310 by horizontal translation through the lateral opening 312. In practice, this operation is effected by the frame 351 sliding by virtue of multiple series of rotating rollers 353*a*, 353*b*, 354*a*, 354*b* which are placed both inside and outside the platen press 310.

In practice, the sliding inside the platen press 310 takes place on two series of inner rollers 353*a*, 353*b* which are mounted on the stand 311 and which are positioned opposite one another respectively upstream and downstream from said press 310. Two series of outer rollers 354*a*, 354*b* are used for the sliding of the frame 351 outside the press 310. They are positioned in the extension of the two series of inner rollers 353*a*, 353*b* respectively, on two support arms 312*a*, 312*b* placed on either side of the lateral opening 312. The unit is arranged in such a way that the horizontal translation of the frame 351 corresponds to the transfer of the heating element 340 between the intermediate position and the maintenance position.

It should be noted that, in contrast to the above-defined vertical translation, the horizontal translation of the frame is not mechanized. It takes place manually using two displacement handles 355.

According to another feature of the invention, the printing device 300 is also provided with fastening means 360 which enable the heating element 340 to be immobilized in the operating position. It must, of course, be possible to reverse such an immobilization in order to preserve the capacity for displacement of the heating element 340. This means that the fastening means 360 must be deactivated prior to the heating element 340 being extracted, and activated before stating up the printing device 300.

The fastening means 360 are particularly advantageously designed to apply the heating element 340 against the inner face 321 of the stationary platen 320 by pulling it from a portion of said stationary platen 320 which is situated substantially opposite said inner face 321. Independently of the immobilization which it effects, the advantage of such an application is that it prevents the heating element 340 from warping under the effect of the heat, and also that it limits the vibrations resulting from the back-and-forth movements of the movable platen 330.

According to another advantageous feature, the fastening means 360 can be accessed from the face of the stationary platen 320, the so-called outer face 322, which is opposite the inner face 321. It should be noted that this accessibility relates to both the positioning of the fastening means 360 and their activation or deactivation.

In this exemplary embodiment, the fastening means 360 have a plurality of tie rods 361 which are placed in the same number of positioning holes 323 (FIG. 2) formed through the stationary platen 320 in a direction substantially perpendicular to the inner face 321. Each tie rod 361 moreover comprises a head in the form of an abutment 362 which bears against a portion of the stationary platen 320 which is substantially opposite the inner face 321, and a threaded end 363 which is screwed into an internal screwthread 341 formed in the heating element 340.

Figure 8:
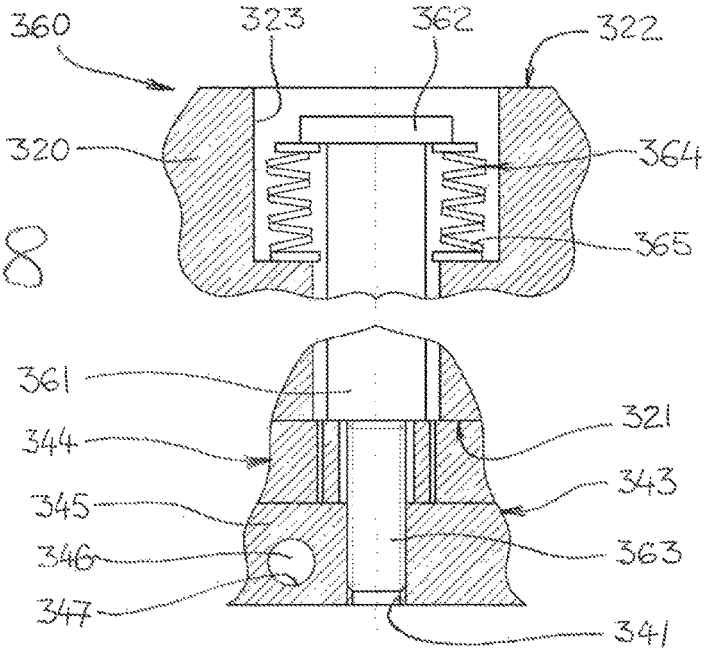
FIG. 8 is a vertical cross-section made through the stationary platen of the press, which displays how the heating element is fastened in the operating position.

As can be clearly seen in FIG. 8, each tie rod 361 in practice takes the form of a threaded rod which passes vertically through the stationary platen 320 from one side to the other. Its head 362 is positioned on the outer face 322 of the stationary platen 320, which makes it difficult to access it directly from outside the press 310. For its part, its threaded end 363 protrudes from the stationary platen 320 so that it can be screwed into the heating element 340 placed just beneath it.

In this exemplary embodiment, the heating element 340 has a composite structure which combines a heating plate 343 and an insulating plate 344 which are positioned one beneath the other. The outer face of the heating plate 343 faces the inside of the platen press 310, in other words opposite the stamping tools, while the outer face of the insulating plate 344 is applied against the stationary platen 320.

According to FIG. 8, the heating plate 343 also has a composite structure, consisting of a thermally conductive plate 345 into which a plurality of heating bodies 346 are incorporated. To do this, housings 347 are formed in the thickness of the thermally conductive plate 345 and they are dimensioned so as to receive heating bodies 346 in the form of electrical resistors.

Figure 9:
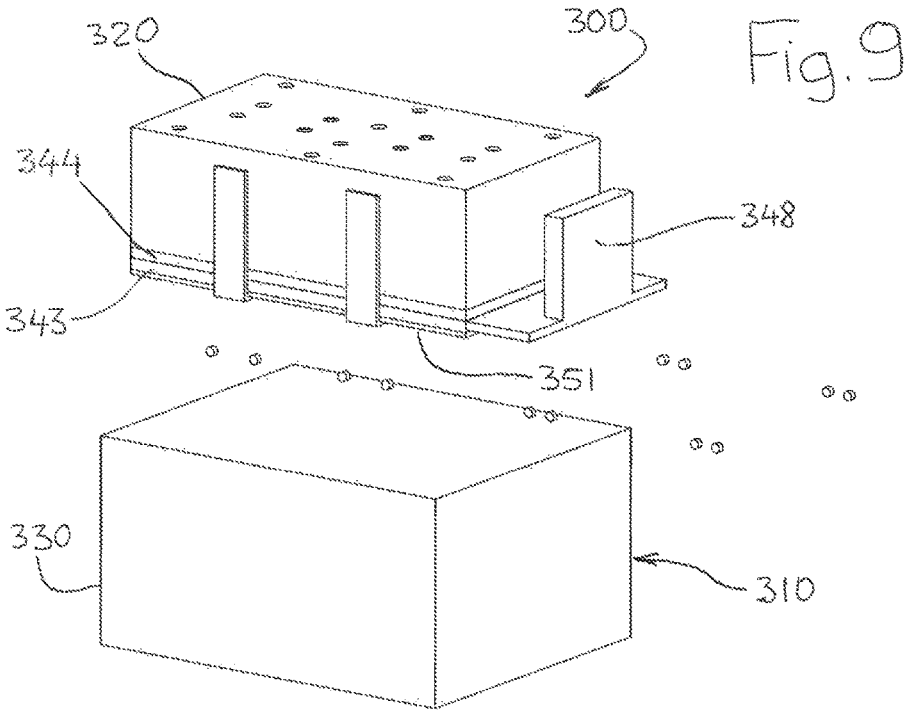
FIGS. 9 and 10 are similar views to FIGS. 3 and 7 but which correspond to an alternative embodiment which is distinguished by associating an electrical connection box with the heating element.
Figure 10:
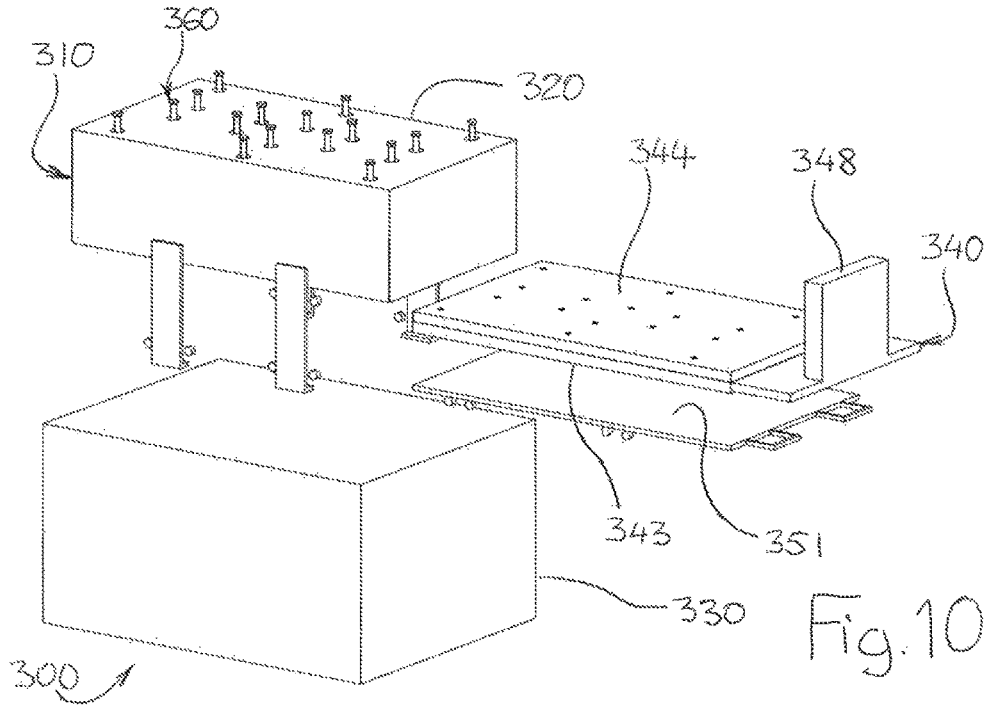

The wires supplying the various heating bodies 346 with electricity leave the thermally conductive plate 345 along the upstream and downstream edges and are then bunched together and connected to a same connection box 348 (FIGS. 9 and 10) which is fixed laterally, on the side on which the operator of the machine 1 stands. This connection box 348 is particularly advantageously integrally connected to the heating element 340.

In line with this and according to another advantageous feature, the printing device 300 also has fastening means enabling the connection box 348 to be integrally connected to the stand 311 of the platen press 310. In practice, the purpose of using such fastening means is not solely to hold the connection box 348, but also to enable the heating element 340 to be pre-positioned relative to stationary platen 320 before they are integrally connected by the tie rods 361. In this example, the fastening means consist of screws which are screwed directly into the stand (not shown in FIGS. 9 and 10 but visible in FIG. 2) of the platen press 310.

It should be noted that, even if it appears to be theoretically possible to use just one tie rod 361 to perform the immobilization function, several tie rods will preferably be used, distributed over the whole surface of the heating element 340, according to the exemplary embodiment in FIGS. 1 to 10. It may moreover be observed in this respect that the tie rods are not distributed regularly here. The reason for this is both because each tie rod 361 is positioned according to the location of the various heating bodies 346 which make up the heating element 340, and because there must be more tie rods 361 in the central zone of the heating element 340, given that the stresses are greatest at this point.

As can be seen clearly in the cross-section in FIG. 8, each positioning hole 323 has a substantially greater cross-section than that of the tie rod 361 which is associated with it. The purpose of this feature is to create radial play between the tie rod 361 and the stationary platen 320 so as to allow the free thermal expansion of the heating element 340.

Each tie rod 361 particularly advantageously has an elastically deformable element 364 which is inserted axially between the head 362 and the portion of the stationary platen 320 which serves as a bearing surface for said tie rod 361. For its part, this feature is intended to compensate the compressive forces which are generated within the platen press 310, as well as the thermal expansion to which the heating element 340 is subject in the direction of the tie rods 361.

In this exemplary embodiment, each elastically deformable element 364 consists of a stack of conical washers 365 which are positioned head to tail so as to form a very stiff compact spring.

Of course, the invention relates more generally to any machine 1 for processing a succession of elements in the form of sheets, which comprises at least one printing device 300 as described above. Such a processing machine 1 can be a simple gilding machine as in the embodiment chosen to illustrate the invention, but it can also incorporate other functions such as, for example, cutting, blanking, waste removal, etc.

The invention claimed is:

1. A device for printing a succession of elements in the form of sheets, comprising:

a platen press configured for depositing a colored or metalized film coming from at least one stamping foil on each sheet;

the platen press comprising a first platen and an opposing movable platen movable toward and away from the first platen;

at least one stamping tool on the first platen;

a heating element located and configured for bringing the stamping tool to a temperature selected so that a stamping operation takes place in a hot environment within the platen press; and a mounting arrangement configured and operable to hold the heating element in an operating position in which the heating element is placed between the first platen and the at least one stamping tool on the first platen, and to move the heating element to a maintenance position in which the heating element is arranged outside the platen press.

2. A printing device according to claim 1, wherein said mounting arrangement comprises a heating element transport device configured for transporting the heating element between the operating position and the maintenance position.

3. A printing device according to claim 2, further comprising a frame located and configured for supporting each stamping tool associated with the first platen, the frame is mounted on the heating element transport device for moving in displacement between a use position in which the frame extends opposite and in contact with the heating element in the operating position, and an extraction position in which the frame is arranged outside the platen press, wherein the frame is comprised in said transport device and is configured for transporting the heating element between the operating position and the maintenance position when the frame is displaced between the use position and the extraction position.

4. A printing device according to claim 1, further comprising a fastener on the first platen configured for immobilizing the heating element in the operating position.

5. A printing device according to claim 4, wherein the fastener is configured and operable for applying the heating element against the inner face of the first platen by pulling the heating element from a portion of the first platen which is situated substantially opposite the inner face of the first platen.

6. A printing device according to claim 4, wherein the fastener is located to be accessed from an outer face of the first platen, which is opposite the inner face thereof.

7. A printing device according to claim 4, wherein the fastener comprises at least one tie rod which is placed in a positioning hole formed through the first platen in a direction substantially perpendicular to the inner face of the platen, each tie rod comprises a head in the form of an abutment which bears against a portion of the first platen and which is substantially opposite the inner face of the first platen, and a threaded end which is screwed into an internal screwthread formed in the heating element.

8. A printing device according to claim 7, wherein each positioning hole has a cross-section substantially greater than a cross-section of the tie rod associated with it.

9. A printing device according to claim 7, wherein each tie rod has an elastically deformable element which is inserted axially between the head and the portion of the first platen which serves as a bearing surface for the tie rod.

10. A printing device according to claim 9, wherein each elastically deformable element comprises a stack of conical washers positioned head to tail.

11. A printing device according to claim 1, wherein the heating element incorporates a plurality of heating bodies which are connected electrically to at least one connection box, and each connection box is integrally connected to the heating element.

12. A printing device according to claim 11, further comprising a fastener configured for integrally connecting each connection box to the platen press.

13. A machine for processing a succession of sheet elements which comprises at least one printing device according to claim 1.

14. A printing device according to claim 1, wherein the first platen is a stationary platen which is opposable to the movable platen.

15. A printing device according to claim 3, wherein said platen press comprises a stand, wherein the frame is guided through an opening in the stand between the operating position and the maintenance position, the maintenance position being outside of the platen press.

16. A printing device according to claim 15, further comprising support arms on the stand, outside the platen press, for supporting the frame in the maintenance position.

17. A printing device according to claim 16, wherein said transport device further comprises a plurality of rollers arranged for guiding the frame from the operating position to the maintenance position.

18. A printing device according to claim 17, wherein said plurality of rollers comprise rollers on said stand and rollers on said support arms.

* * * * *